United States Patent [19]

Napora

[11] 3,972,516

[45] Aug. 3, 1976

[54] SHAPES FOR USE IN LINING METALLURGICAL VESSELS

[75] Inventor: Nicholas Napora, Pittsburgh, Pa.

[73] Assignee: Dresser Industries, Inc., Dallas, Tex.

[22] Filed: June 23, 1975

[21] Appl. No.: 589,504

[52] U.S. Cl. ..... 266/283; 52/249

[51] Int. Cl.[2] ..... C21C 5/44

[58] Field of Search ..... 110/1 A, 1 B; 13/35; 266/39, 43, 283; 52/249, 267, 268, 269, 608

[56] References Cited

UNITED STATES PATENTS

| | | | |
|---|---|---|---|
| 2,526,289 | 10/1950 | Smith | 266/43 X |
| 2,818,248 | 12/1957 | Kelsey | 266/43 |
| 3,140,333 | 7/1964 | Tredennick et al. | 266/43 |
| 3,393,482 | 7/1968 | Hannah | 52/249 |
| 3,394,521 | 7/1968 | Coleman | 52/574 |
| 3,401,226 | 9/1968 | Renkey | 13/35 |
| 3,429,487 | 2/1969 | Tredennick et al. | 266/43 X |
| 3,635,459 | 1/1972 | Mare | 266/43 |

*Primary Examiner*—Roy Lake
*Assistant Examiner*—Paul A. Bell
*Attorney, Agent, or Firm*—Raymond T. Majesko; John N. Hazelwood

[57] ABSTRACT

The invention relates to refractory shapes for use in the lowermost courses of the walls of ladles and the like where an adjustment for a taper may be necessary.

10 Claims, 4 Drawing Figures

SHAPES FOR USE IN LINING METALLURGICAL VESSELS

In the manufacture of steel and steel alloys it is conventional to tap molten metal from a furnace into a ladle in a pouring pit. The pouring pit is usually at a lower elevation than the floor on which the metallurgical furnaces reside, so that the molten metal may flow by gravity from the furnace to the ladle. Spaced from the ladle are a plurality of ingot molds, and the ladle of molten metal is moved through the pouring pit into a position above these ingot molds. Molten metal is poured from the ladle into the ingot molds to form ingots. In the new continuous casting process, molten metal is poured from the ladle into tundishes. Usually the metal is poured from the ladle through a nozzle which opens through the bottom thereof. However, the metal is sometimes poured over the lip of the ladle.

Ladles are lined with refractory brick, usually fire clay or high alumina brick. Because the brick joints must not be penetrated by molten metal, prior art ladle brick were usually made from brick which tended to bloat; that is, which have a volume expansion (on heat-up) as great as 80%. The bloating of prior art ladle brick enabled the construction of ladle linings without a great degree of care. With the advent of the newer steel-making processes, however, the hot metal temperature exceeds the refractory limit of bloating fire clay brick. Therefore, it is necessary that more highly refractory fire clay and high alumina brick having only slight expansion on heat-up be used for lining ladles. As a result, new ladle lining construction techniques are required, which techniques require much greater precision.

There is shown in FIG. 1 of U.S. Pat. Nos. 2,818,248 and 3,140,333 a thick tapered mortared joint identified by dots. Mortar was and still is used in many shops to start the lay-up of the ladle sidewall so that the top surface of the first starter course is reasonably square with the back-up or safety lining. When the steel industry turned to lining ladles with high alumina brick, the heavy mortar joint appeared inadequate and was supplanted with starter shapes similar to those described in U.S. Pat. No. 3,393,482.

These types of starter shapes, however, met with a number of deficiencies. Ladles are constructed with different diameters and configurations, i.e., round, oval and round or oval with straight sides. Thus a combination of starter shapes having different side tapers is needed to properly lay up starter courses in most ladles. Ladles are constructed with sidewalls flaring upward or tilting from the vertical at different angles. Thus, to square the top surface of the starter shape with the sidewall, other starter shapes would be required to meet this requirement in most ladles.

Many steel plants construct the ladle bottom sloped to promote steel drainage. This construction produces a geometrical configuration similar to an upside down frustum whose base is not parallel to its top plane. The angle of convergence between the sloping bottom and the sidewall at any given point is different from another point. The limits of the angle of convergence is least at the tapping aperture and greatest at the opposite side. Thus, a starter shape having its top surface sloped to a fixed angle can only be square with the wall at two points and opposite of each other.

In U.S. Pat. No. 2,818,248 referred to previously, shapes are disclosed which have ends that are slightly curved. These shapes cannot swivel but must be offset to maintain tight joints when laid to follow the curve of a ring of brick in the sidewall lining. However, offsetting the brick reduces the effective thickness of the lining wall. The patentee suggests a solution to this problem by providing an additional series of short brick. The above patent was acknowledged in U.S. Pat. No. 3,140,333 which added an improvement thereto by providing another shape having front and back cords of the same length.

Accordingly, it is among the objects of the present invention to provide refractory shapes, particularly as the starter courses or rings for steel-making ladles that can conform to the varying tapers throughout the circumference of the ladle and provide a square relationship with the outer shell or insulating lining.

In accordance with the present invention, there is provided a metallurgical vessel having an outer metal shell, a refractory bottom and upwardly tapering sidewalls composed of a plurality of rings of refractory shapes. There is a lowermost ring constructed of shapes having opposed upper and lower surfaces, side surfaces and end surfaces. The upper surfaces are convexly curved between the side surfaces. The lower surfaces are relatively flat. There is a second ring disposed above the first ring. The second ring is constructed of shapes having opposed upper and lower surfaces, side surfaces and end surfaces. The upper surfaces are relatively flat. The lower surfaces are concavely curved and are mated with the convexly curved surfaces of the lowermost ring shapes. The second ring of shapes are adapted to rotate on the lowermost ring toward and away from the metal shell to provide a relatively square relationship with said metal shell.

Steel making vessels generally have a taper between about 90° and 105° and the second ring of shapes is capable of rotating toward and away from the metal shell to a slope up to about 15° from the horizontal.

Figure 1:
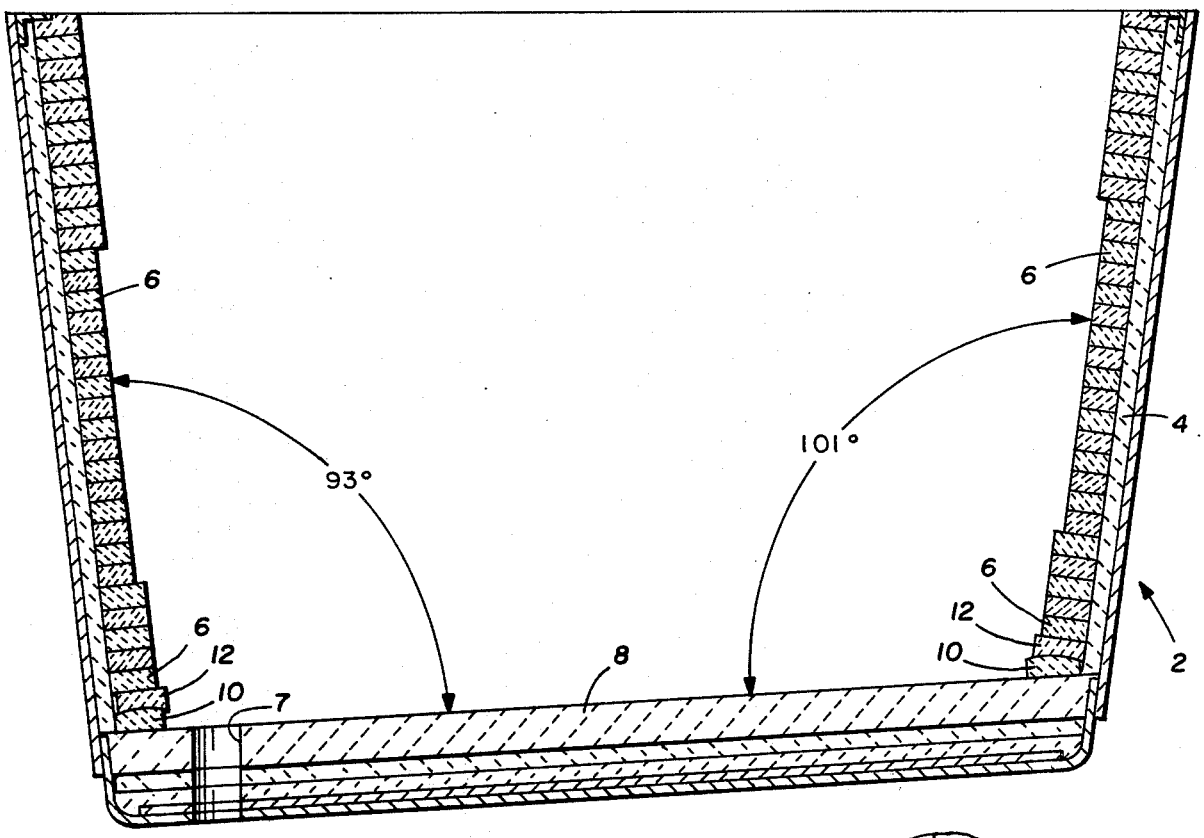
FIG. 1 is an elevation view in cross-section of a typical steel-making ladle with the starter courses on opposite sides.

Referring to the drawings, there is shown, in FIG. 1, ladle linings according to the present invention. The ladle has a flared outer metal shell 2 which contains a back-up or insulating lining 4 and a refractory brick lining 6. Metal is removed from the ladle by pouring through a spout 7 which usually contains a refractory nozzle. The bottom of the ladle is lined with refractory materials 8. For a discussion and illustrations of standard shapes for lining ladles used throughout the refractories industry, see Page 478 of Modern Refractory Practice, Fourth Edition, published by Harbison Walker Refractories Company. For a discussion of the selection of standard shapes to provide circular linings of various diameters and handy tables, see Pages 536 through 558 of Modern Refractory Practice (above noted). The shapes 10 and 12 of the present invention comprise the two lowermost courses of the refractory brick in the sidewall lining.

Figure 2:
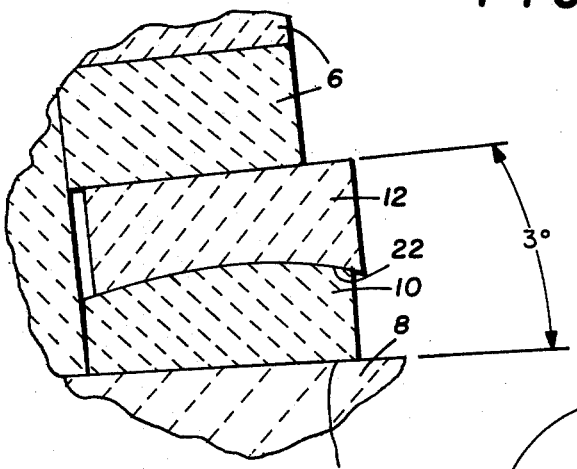
FIGS. 2 and 3 are enlarged portions of FIG. 1.
Figure 3:
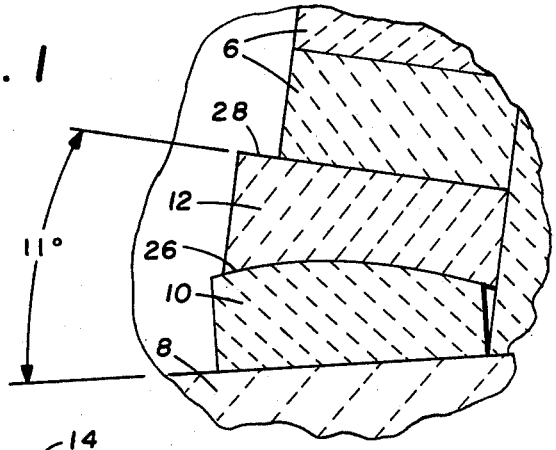
Figure 4:
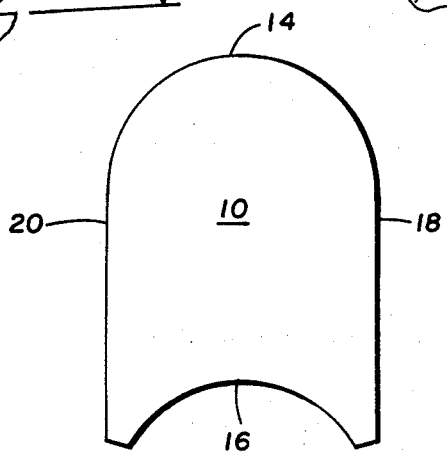
FIG. 4 is a plan view of the shapes utilized in the starter courses.

The preferred brick shapes used in the lowermost courses of ladles constructed according to the teachings of this invention are best understood by reference to the blow-up portions of FIG. 1 and FIG. 2. The brick shapes 10 and 12 have end surfaces 14 and 16 which are arcuate in configuration. The shape 10 is shown in FIG. 2, however, the end surfaces of shape 12 are similar in configuration. Preferably, the end surfaces are semi-circular in configuration so that when laid and butted together with adjacent shapes, they can swivel to suit the contour of the ring and maintain tight joint integrity. The shapes also contain opposed side surfaces 18 and 20 which are planer and substantially parallel. One of the side surfaces of the shapes 10 and 12, the surface that faces the interior of the vessel, has a thickness greater than the surface adjacent the metal shell 2.

The shapes 10 in the lowermost course contains a convexly curved upper surface 22 between the side surfaces and a relatively flat lower surface 24. The shapes 12 in the second ring or course, disposed above the first ring contain a lower surface 26 which is concavely curved and an upper surface 28 which is relatively flat. Preferably, the convexly curved and concavely curved surfaces have a similar radius of curvature. These two curved surfaces mate on a common interface. The flat surfaces of the shapes are designed with an approximate 7° tilt-away from being parallel to each other to accommodate the approximate average tilt or flare back of the sidewalls in most cases.

As shown in FIG. 1, the sidewall portion nearest the tap hole has a taper of 93° and the opposite sidewall has a taper of 101°. The shapes 12 can rotate toward the interior of the ladle from about 7° to 3° to make its top surface square with the sidewall when laid at the drain aperture end of the ladle. It can rotate toward the metal shell or back-up lining from about 7° to 11° to make its top surface square with the sidewall when laid at the opposite end. The total range of rotation in this ladle is approximately 8°.

As mentioned previously, the side surfaces of the brick are thicker at the interior end than at the exterior end. This difference in thickness is to accommodate a nominal 7° taper of the sidewall with respect to the bottom. This construction enables the bricklayer to easily and accurately tilt back to start the tilting sidewall and maintain tight construction. This imparts flexibility in the construction to better accommodate other problems in normal construction, such as out-off roundness of the vessel, out-off squareness of the bottom with respect to the sidewall and slope built into the bottom for drainage. Additionally, the lower side-wall area where the shapes of the invention are utilized is the area where the steel skull sometimes develops. It may be necessary for these skulls, if they do form, to be mechanically pulled from the ladle before the ladle is again used and this operation of removing the skull is particularly damaging to the lining if the lining construction is such that the skull can anchor itself to the brickwork. This construction should insure a tighter ladle lining at the base of the sidewall and less opportunity for a steel skull to anchor itself to the brickwork.

The present invention is also applicable to lining ladles for other applications, such as iron charging ladles. The construction can be used to advantage in any application where two refractory walls join. The present invention will improve construction in vessels utilizing semi-universal or universal brick linings and also those utilizing arches and wedges in ring construction.

Having thus described the invention in detail and with sufficient particularity as to enable those skilled in the art to practice it, what is desired to have protected by Letters Patent is set forth in the following claims.

The embodiments of the invention in which an exclusive property or privilege is claimd are defined as follows:

1. In a metallurgical vessel having an outer metal shell, a refractory bottom and upwardly tapering sidewalls composed of a plurality of rings of refractory shapes, a lowermost ring constructed of shapes having opposed upper and lower surfaces, side surfaces and end surfaces, the upper surfaces being convexly curved between side surfaces, the lower surfaces being relatively flat, a second ring disposed above said first ring, said second ring constructed of shapes having opposed upper and lower surfaces, side surfaces and end surfaces, the upper surfaces being relatively flat, the lower surfaces being concavely curved and mated with the convexly curved surfaces of the lowermost ring shapes, said second ring of shapes being adapted to rotate on said lowermost ring toward and away from the metal shell to provide a relatively square relationship with said metal shell.

2. The vessel of claim 1, in which the convexly curved and concavely curved surfaces have a similar radius of curvature.

3. The vessel of claim 1, in which the opposed end surfaces of the shapes are arcuate in configuration and are respectively convexly curved and concavely curved for mating with adjacent shapes.

4. The vessel of claim 1, in which the end surfaces of the shapes are semi-circular in configuration.

5. The vessel of claim 1, in which the opposed side surfaces of the shapes are planer and substantially parallel.

6. The vessel of claim 1, in which one of the side surfaces has a thickness greater than the other side surface.

7. The vessel of claim 1, in which the sidewalls have a taper of from about 90° to 105° and said second ring of shapes is capable of rotating toward and away from the metal shell to a slope up to about 15° from the horizontal.

8. A pair of refractory shapes suitable for use in metallurgical vessels consisting essentially of an upper shape and a lower shape, each shape having opposed upper and lower surfaces, side surfaces and end surfaces, the upper surface of the upper shape being relatively flat and the lower surface being concavely curved, the upper surface of the lower shape being convexly curved and the lower surface being relatively flat, said shapes being mated at the convexly curved and concavely curved surfaces, the end surfaces of each of said shapes being respectively convexly curved and concavely curved.

9. The shapes of claim 8, in which the end surfaces are semi-circular in configuration.

10. The shapes of claim 8, in which the opposed side surfaces are planer and substantially parallel and in which one of the side surfaces has a thickness greater than the other side surface.

* * * * *